US007705805B2

(12) United States Patent
Jung et al.

(10) Patent No.: US 7,705,805 B2
(45) Date of Patent: Apr. 27, 2010

(54) PLASMA DISPLAY APPARATUS AND DRIVING METHOD OF PLASMA DISPLAY APPARATUS

(75) Inventors: Yun Kwon Jung, Gumi-si (KR); Sang Jun Lee, Yangsan-si (KR); Jang Hyun Lim, Cheongju-si (KR); Yang Ki An, Gyeongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 941 days.

(21) Appl. No.: 11/423,041

(22) Filed: Jun. 8, 2006

(65) Prior Publication Data

US 2007/0236415 A1 Oct. 11, 2007

(30) Foreign Application Priority Data

Apr. 6, 2006 (KR) ..... 10-2006-0031429

(51) Int. Cl.
*G09G 3/28* (2006.01)

(52) U.S. Cl. ..... 345/60; 315/169.4

(58) Field of Classification Search ..... 345/60–72, 345/204, 690, 692; 315/169.4
See application file for complete search history.

(56) References Cited

U.S. PATENT DOCUMENTS 6,249,087 B1 * 6/2001 Takayama et al. ..... 315/169.1
6,525,486 B2 * 2/2003 Awamoto et al. ..... 315/169.4
6,844,685 B2 * 1/2005 Lee ..... 315/169.3
2002/0075206 A1 * 6/2002 Takeda et al. ..... 345/60
2003/0107532 A1 * 6/2003 Choi ..... 345/60
2005/0093779 A1 * 5/2005 Kim et al. ..... 345/60
2006/0145958 A1 * 7/2006 Han ..... 345/67

FOREIGN PATENT DOCUMENTS

CN 1652176 A 8/2005
KR 1020030075337 9/2003
KR 20050121866 * 12/2005

OTHER PUBLICATIONS

Chinese Office Action dated Jun. 6, 2008, for Application No. 2006100874542, 4 pages.

* cited by examiner

*Primary Examiner*—Amr Awad
*Assistant Examiner*—Kenneth Bukowski
(74) *Attorney, Agent, or Firm*—Fish & Richardson P.C.

(57) ABSTRACT

The present invention provides a plasma display apparatus comprising a second driver supplying a first bias signal with a voltage maintained at a first bias voltage in a reset period and an address period, a first sustain rising signal that gradually rises from the first bias voltage to a second bias voltage, and a second bias signal with a voltage maintained at the second bias voltage, to the second electrode.

23 Claims, 9 Drawing Sheets

PLASMA DISPLAY APPARATUS AND DRIVING METHOD OF PLASMA DISPLAY APPARATUS

This Nonprovisional application claims priority under 35 U.S.C. §119(a) on patent application Ser. No. 10-2006-31429 filed in Korea on Apr. 6, 2006 the entre contents of which are hereby incorporated by reference.

BACKGROUND OF THE INVENTION

1. Field of the Invention

This document relates to a plasma display apparatus and a driving method of the plasma display apparatus 2. Description of the Background Art Generally, a plasma display apparatus comprises a plasma display panel in which a plurality of electrodes are formed, and a driver for the plurality of electrodes of the plasma display panel. The driver of the plasma display apparatus supplies a driving signal. In accordance to the driving signal, a reset discharge, an address discharge, and a sustain discharge are generated in a discharge cell of the plasma display panel. When the discharges are generated in the discharge cell, a discharge gas filled in the discharge cell generates vacuum ultraviolet rays. The vacuum ultraviolet rays causes a phosphor formed in the discharge cell to emit light, and an image is displayed.

In the plasma display apparatus, a noise due to a coupling effect occurring between electrodes overlaps with the driving signal. The noise causes to generate an Electro Magnetic Interference, and causes an operation of the plasma display apparatus to be unstable.

SUMMARY OF THE INVENTION

A plasma display apparatus in accordance of an embodiment of the present invention comprises a plasma display panel in which a first electrode and a second electrode are formed, and a second driver for supplying a first bias signal with a voltage maintained at a first bias voltage, a first sustain rising signal that gradually rises from the first bias voltage to a second bias voltage, and a second bias signal with a voltage maintained at the second bias voltage, to the second electrode.

A driving method of a plasma display apparatus in accordance with an embodiment of the present invention comprises supplying a first bias signal with a voltage maintained at a first bias voltage, supplying a first sustain rising signal that gradually rises from the first bias voltage to a second bias voltage to the second electrode and supplying a second bias signal with a voltage maintained at the second bias voltage to the second electrode.

A plasma display apparatus in accordance with another embodiment of the present invention comprises a plasma display panel in which a first electrode and a second electrode are formed, a first driver for supplying one signal of a scan rising signal, a scan signal and a scan bias voltage and a second driver for supplying a first sustain rising signal that gradually rises from a first bias voltage to a second bias voltage after a predetermined duration of time from a start time point of the scan rising signal and a second bias signal with a voltage maintained at the second bias voltage, to the second electrode during the supply of the scan signal and the scan bias signal.

BRIEF DESCRIPTION OF THE DRAWINGS

The embodiment of the invention will be described in detail with reference to the following drawings in which like numerals refer to like elements.

DETAILED DESCRIPTION OF PREFERRED EMBODIMENTS

Figure 1:
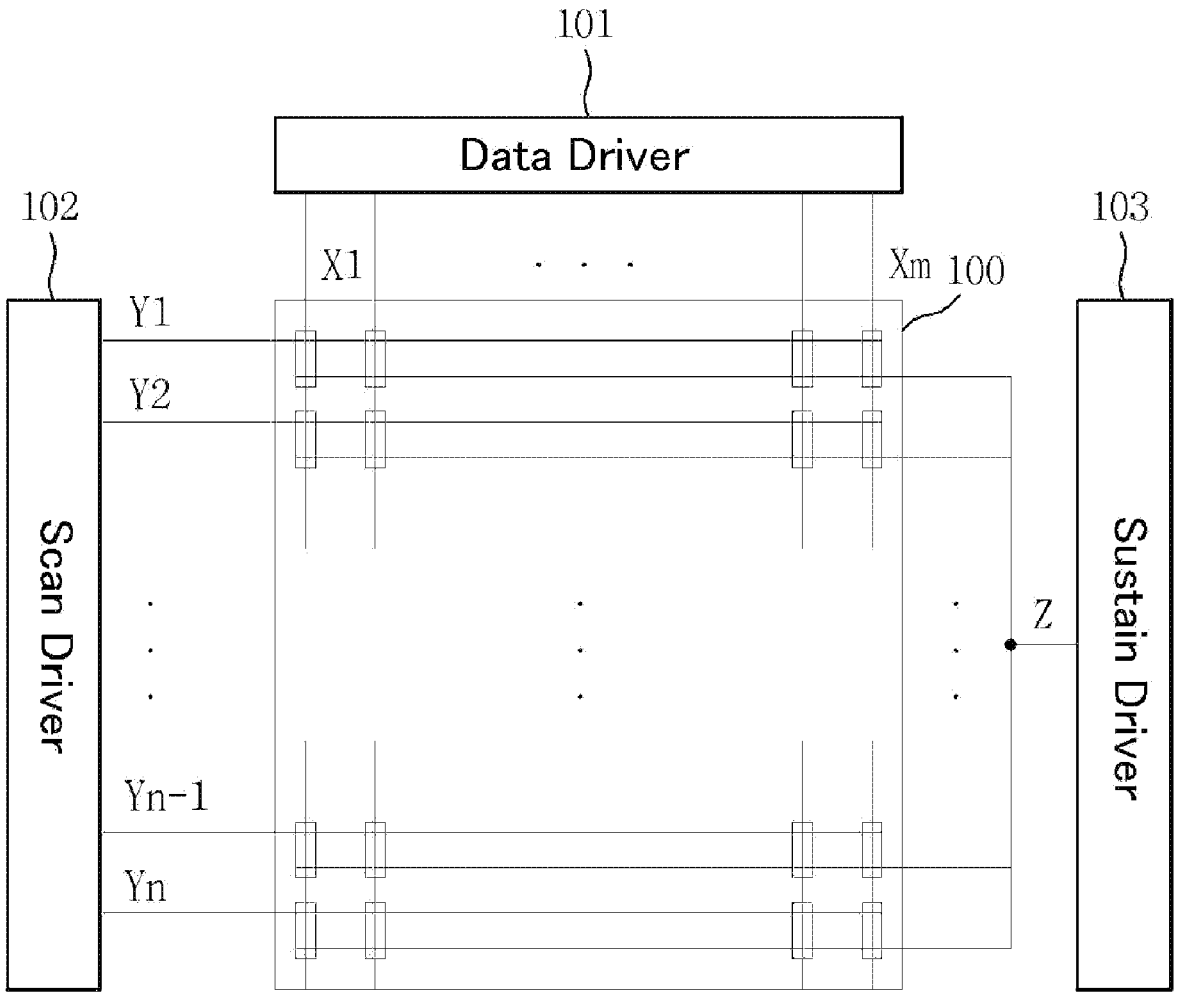
FIG. 1 illustrates a plasma display apparatus in accordance with an embodiment of the present invention.

Embodiments of the present invention will be described in a more detailed manner with reference to the drawings.

A plasma display apparatus in accordance of an embodiment of the present invention comprises a plasma display panel in which a first electrode and a second electrode are formed, and a second driver for supplying a first bias signal with a voltage maintained at a first bias voltage, a first sustain rising signal that gradually rises from the first bias voltage to a second bias voltage, and a second bias signal with a voltage maintained at the second bias voltage, to the second electrode.

A gradient of the sustain rising signal may range from 2 V/μs to 20 V/μs.

The second driver may comprise a first bias voltage supplying switch unit and a second bias voltage supplying switch unit, wherein the first bias voltage supply switch unit may comprise one terminal connected to a bias voltage source, and wherein the second bias voltage supply switch unit may comprise one terminal connected to the other terminal of the first bias voltage supply switch unit and the other terminal connected to the second electrode.

The first bias voltage maybe substantially equal to a ground level voltage.

The plasma display apparatus further may comprise a first driver for driving the first electrode, wherein the first driver may supply a scan rising signal to the first electrode, and the second driver may cause the second electrode to enter a floating state during the supply of the scan rising signal.

A magnitude of a slope of the scan rising signal may be more than the magnitude of the slope of the sustain rising signal.

The first driver may supply a rising signal that gradually rises from a scan bias voltage after the supply of the scan rising signal, and the duration of a supply period of the scan rising signal may be 2 times to 25 times more than the duration of the supply period of the rising signal.

The scan bias voltage may be a negative polarity voltage.

The second driver may cause the second electrode to enter a floating state after a predetermined duration of time from a start time point of the scan rising signal supplied by the first driver.

The predetermined time may be equal to or less than 10 μs.

The plasma display apparatus may further comprise a first driver for driving the first electrode, wherein the first driver may supply a scan rising signal to the first electrode, and wherein the second driver may comprise a switch unit for supplying the first sustain rising signal, that gradually rises due to the charge of a ramp generation capacitor, to the second electrode during the supply of the scan rising signal.

The second driver may supply a second rising signal that gradually rises from the second bias voltage to a third bias voltage, to the second electrode.

The third voltage may be substantially equal to a sustain voltage for generating a sustain discharge.

The plasma display apparatus may further comprise a first driver, wherein the first driver may supply a rising signal that rises from a scan bias voltage to the first electrode, and the second driver may cause the second electrode to enter a floating state for forming the second sustain rising signal during the supply of the rising signal.

The second driver may supply a third bias signal with a voltage maintained at the third voltage, to the sustain electrode after the supply of the second sustain rising signal.

The second driver may supply a sustain falling signal falling to a ground level voltage gradually after the supply of the third bias signal.

The second driver may recover an energy from the second electrode to supply the sustain falling signal.

The plasma display apparatus may further comprise a first driver, wherein the first driver may supply one or more setup signals to the first electrode in a reset period.

A driving method of a plasma display apparatus in accordance with an embodiment of the present invention comprises supplying a first bias signal with a voltage maintained at a first bias voltage, supplying a first sustain rising signal that gradually rises from the first bias voltage to a second bias voltage to the second electrode and supplying a second bias signal with a voltage maintained at the second bias voltage to the second electrode.

The first bias voltage maybe substantially equal to a ground level voltage.

The second electrode may enter a floating state to form the first sustain rising signal during the supply of a scan rising signal to the first electrode.

The second electrode may enters the floating state after a predetermined duration of time from a start time point of the scan rising signal.

A second sustain rising signal that rises from the second bias voltage to a third bias voltage maybe supplied to the second electrode.

A rising signal that rises from a scan bias voltage may be supplied to the first electrode, and the second electrode may enter a floating state during the supply of the rising signal.

A third bias signal with a voltage maintained at the third bias voltage, may be supplied to the second electrode after the supply of the second sustain rising signal.

A plasma display apparatus in accordance with another embodiment of the present invention comprises a plasma display panel in which a first electrode and a second electrode are formed, a first driver for supplying one signal of a scan rising signal, a scan signal and a scan bias voltage and a second driver for supplying a first sustain rising signal that gradually rises from a first bias voltage to a second bias voltage after a predetermined duration of time from a start time point of the scan rising signal and a second bias signal with a voltage maintained at the second bias voltage, to the second electrode during the supply of the scan signal and the scan bias signal.

The first driver may supply a rising signal to the first electrode after a supply of the scan bias signal, and the second driver may supply a second sustain rising signal rising from the second bias voltage to a third bias voltage gradually during the supply of the rising signal.

The second driver may supply a sustain falling signal that gradually falls from the third bias voltage to the second electrode after a supply of the second sustain rising signal.

FIG. 1 illustrates a plasma display apparatus in accordance with an embodiment of the present invention. As shown in FIG. 1, the plasma display apparatus in accordance with an embodiment of the present invention comprises a plasma display panel 100, a data driver 101, a scan driver 12, and a sustain driver 103.

The data driver 101 supplies a data signal to an address electrode of the plasma display panel 100.

The scan driver 102 supplies a reset signal for resetting a discharge cell, a scan signal for selecting a discharge cell, and a sustain signal for generating a sustain discharge in the selected discharge cell to a scan electrode of the plasma display panel 100.

The sustain driver 103 supplies a bias voltage and a sustain signal for generating the sustain discharge to a sustain electrode of the plasma display panel 100.

Hereinafter, the scan driver 102 and the sustain driver 103 will be described with reference to the drawings.

Figure 2:
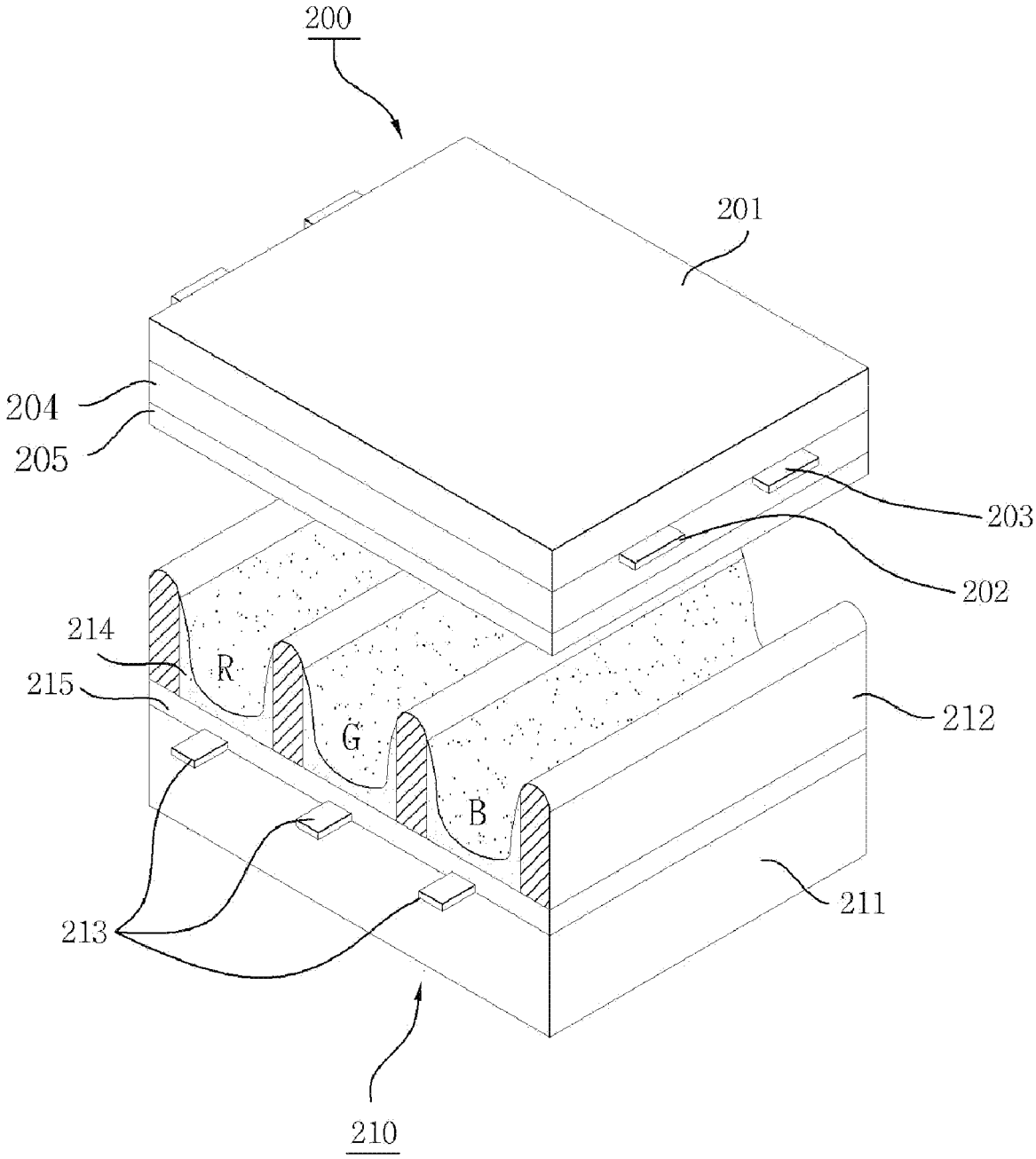
FIG. 2 illustrates an embodiment of a plasma display panel comprised in the plasma display apparatus in accordance with the embodiment of the present invention.

FIG. 2 illustrates an embodiment of a plasma display panel comprised in the plasma display apparatus in accordance with the embodiment of the present invention. As shown in FIG. 2, a plasma display panel comprised in the plasma display apparatus in accordance with the embodiment of the present invention comprises a front panel 201 and a rear panel 211. The front panel 201 comprises a front substrate 201 in which a scan electrode 202 and a sustain electrode 203 are formed. The rear panel 211 comprises a rear substrate 211 in which an address electrode 213 intersecting the scan electrode 202 and the sustain electrode 203 is formed.

A upper dielectric layer 204 is formed on the scan electrode 202 and the sustain electrode 203. The upper dielectric layer 204 insulates the scan electrode 202 and the sustain electrode 203. A protective layer 204 is formed on the upper dielectric layer 204. The protective layer 204 is formed by a deposition of a material such as magnesium oxide (MgO) on the upper dielectric layer 204.

The address electrode 213 receives a data signal. A lower dielectric layer 215 is formed on the address electrode 213. The lover dielectric layer 215 insulates address electrodes. A barrier rib 215 is formed on the lower dielectric layer 215. A discharge gas is filled in the discharge cell formed by the barrier rib 212. A phosphor is formed between the barrier ribs.

As shown in FIG. 2, each of the scan electrode 202 and the sustain electrode is formed in the form of single layer. However, at least one of the scan electrode and the sustain electrode may comprise a bus electrode and a transparent electrode. The present invention is not limited to a structure of a plasma display panel shown in FIGS. 2*a* and 2*b*. For example, at least one of the upper dielectric layer 204 and the lower dielectric layer 205 may comprise two layers.

Figure 3:
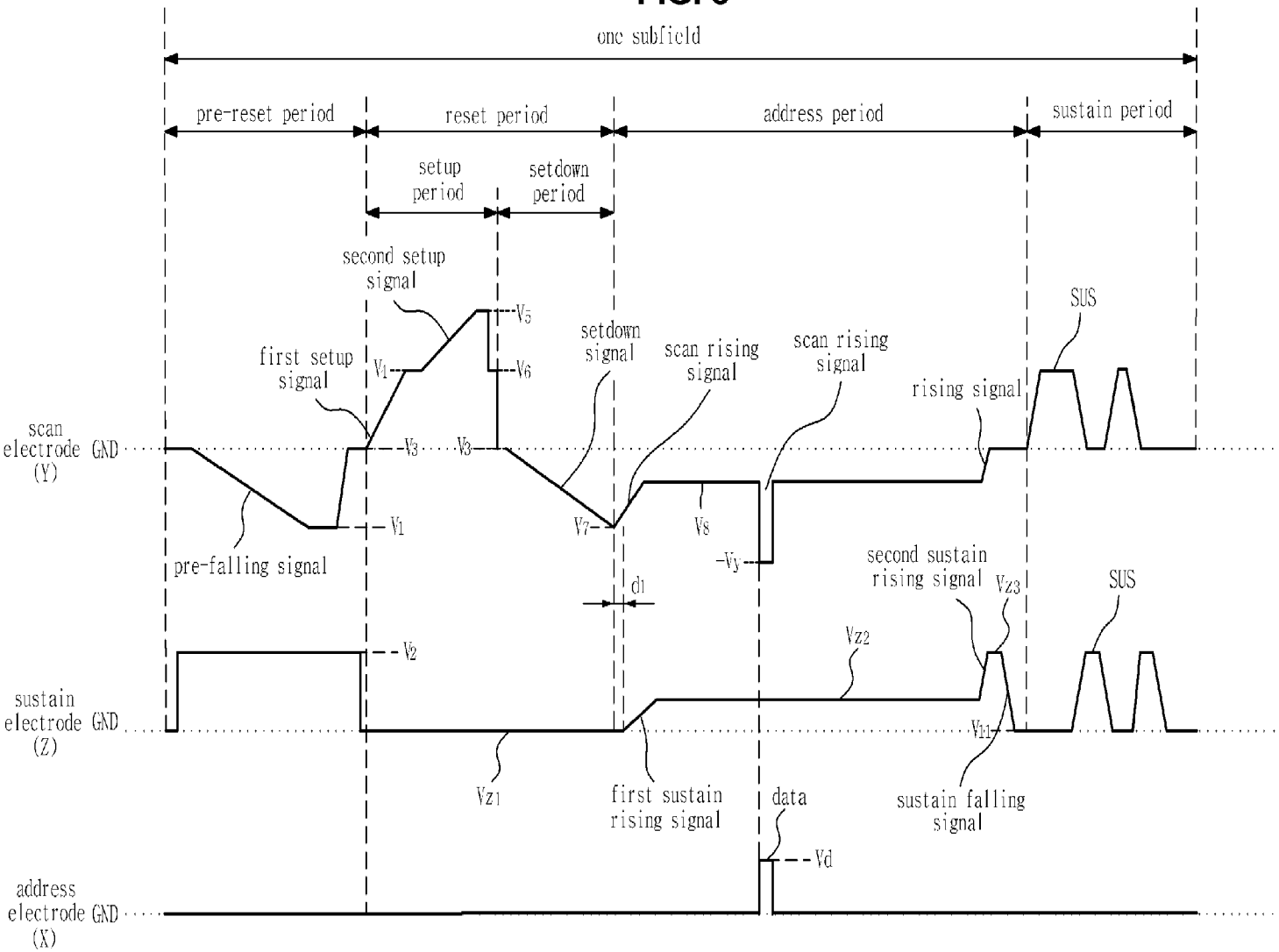
FIG. 3 illustrates an example of a driving signal of the plasma display apparatus in accordance with the embodiment of the present invention.

FIG. 3 illustrates an example of a driving signal of the plasma display apparatus in accordance with the embodiment of the present invention. As shown in FIG. 3, the plasma display apparatus in accordance with the embodiment of the present invention operates according to a driving signal supplied in a subfield comprising a pre-reset period, a reset period, an address period, and a sustain period. The data driver 101, the scan driver 102 and the sustain driver 103 (refer to FIG. 1) supply driving signals to the address electrode X, the scan electrode Y, and the sustain electrode Z, respectively.

In the pre-reset period, the scan driver 102 in FIG. 1 supplies a pre falling signal that falls gradually to the scan electrode Y. The pre falling signal falls from a ground level voltage to a first negative voltage V1. During the supply of the pre falling signal, the sustain driver 103 supplies a second positive voltage V2 to the sustain electrode Z for a predetermined time. A magnitude of the second positive voltage V2 is substantially equal to the magnitude of a sustain voltage which is the highest voltage of a sustain signal supplied in the sustain period.

When the pre falling signal is supplied to the scan electrode Y in the prc7 reset period and the second positive voltage V2 is supplied to the sustain electrode Z in the pre-reset period, a positive wall charge is accumulated on the scan electrode Y and a negative wall charge is accumulated on the sustain electrode Z. Accordingly, although a voltage of a setup signal supplied to the scan electrode Y in the reset period is small, a setup discharge is sufficiently generated.

In a set-up period of a reset period, the scan driver 102 supplies a first setup signal rising from a third voltage V3 to a fourth voltage V4 to the scan electrode Y, and supplies a second setup signal rising from the fourth voltage V4 to a fifth voltage V5 gradually to the scan electrode Y. The third voltage V3 is substantially equal to a ground level voltage.

In a set-down period, the scan driver 102 supplies a set-down signal gradually falling from the third voltage V3 to a seventh voltage V7 to the scan electrode Y.

The sustain driver 103 supplies a bias signal to the sustain electrode Z in the reset period. The highest voltage of the bias signal is substantially equal to a first bias voltage Vz1. Accordingly, a weak erase discharge is generated. The weak erase discharge uniformly forms wall charges in discharge cells.

In an address period, the scan driver 102 supplies a scan rising signal that gradually rises from the seventh voltage V7 to a eighth voltage V8 to the scan electrode Y. A slope of the scan rising signal is substantially equal to the slope of the second setup signal. The scan driver 102 supplies a scan bias signal with a voltage maintained at the eighth voltage V8 to the scan electrode Y. The duration of the supply period may range from 10 μs to 50 μs. When the duration of the supply period ranges from 10 μs to 50 μs, a magnitude of a noise decreases, and a time margin is secured.

The sustain driver 103 supplies a sustain rising signal that gradually rises from the first bias voltage Vz1 to a second bias voltage Vz2 after the duration of d1 period from a start time point of the scan rising signal supplied by the scan driver 102. Namely, a supply time point of the scan rising signal is earlier than the supply time point of the sustain rising signal by the duration of d1 period. The first rising signal may be supplied to the scan electrode Y in the address period before a first scan signal is supplied to the scan electrode Y. A magnitude of a slope of the scan rising may be more than the magnitude of the slope of the first sustain rising signal.

The sustain driver 103 supplies a second bias signal with a voltage maintained at the second bias voltage Vz2 in the address period after the supply of the first sustain rising signal.

A noise generated when the scan rising signal and the first sustain rising signal are supplied to the scan electrode Y and the sustain electrode respectively, will be described with reference to FIGS. 4*a* and 4*b*.

Figure 4A:
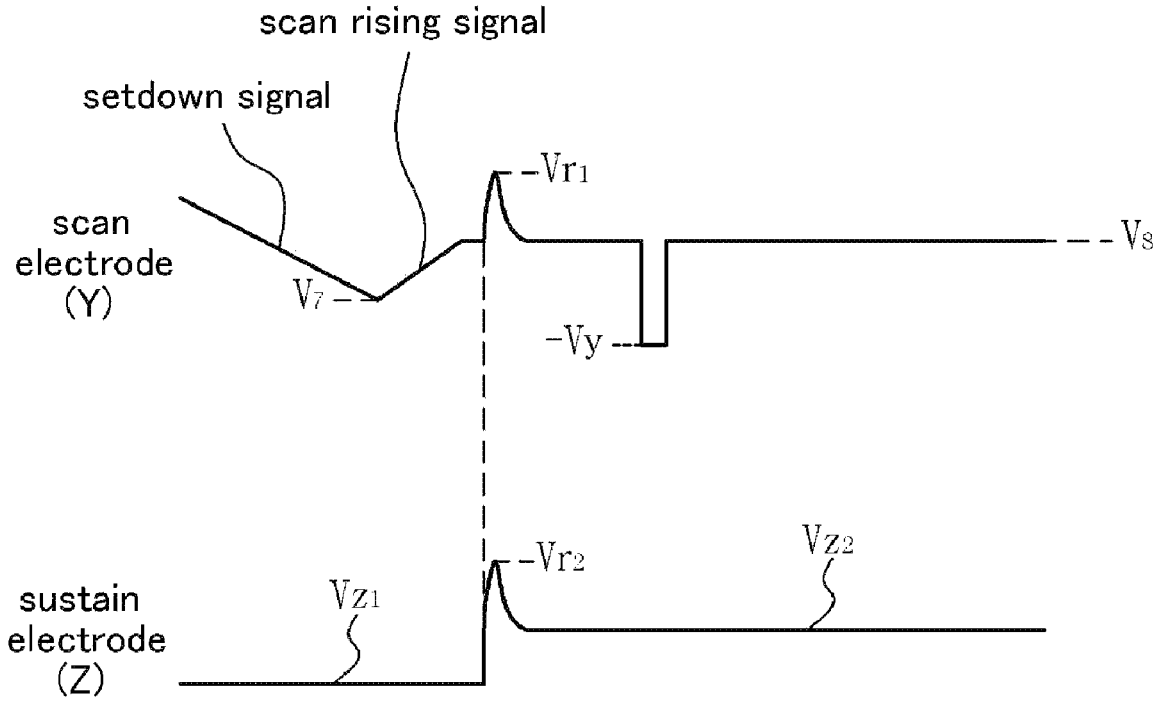
FIG. 4*a* and FIG. 4*b* illustrates a noise generated when a scan rising signal is supplies to a scan electrode and a first sustain rising signal is supplied to the sustain electrode.

As shown in FIG. 4*a*, when the scan rising signal is supplied to the scan electrode Y and the first sustain rising signal is not supplied to the sustain electrode Z, a peaking noise rising from Vr1 to Vr2 is generated due to a coupling effect between sustain electrodes or between the sustain electrode and the scan electrode at a time point when a voltage of the sustain electrode Z is changed from the first bias voltage Vz1 to the second bias voltage. Accordingly, an electromagnetic interference (EMI) due to the peaking noise is generated.

Figure 4B:
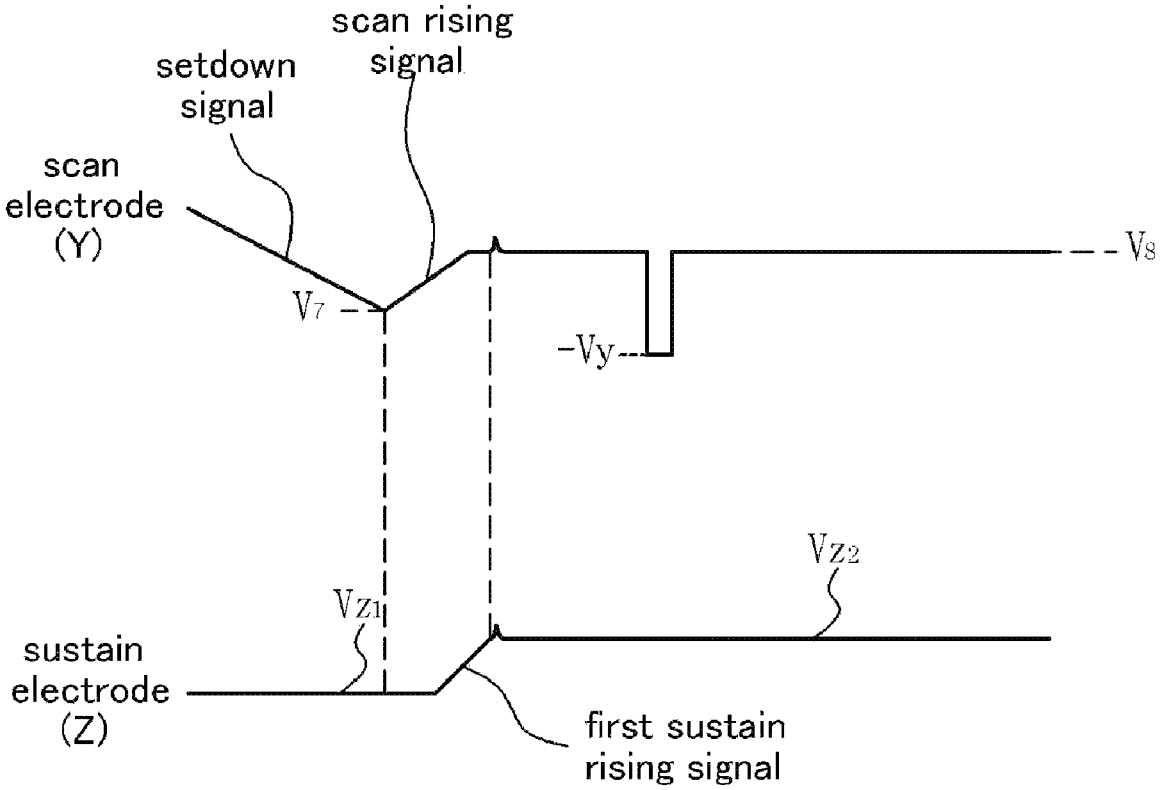

As shown in FIG. 4*b*, when the scan rising signal is supplied to the scan electrode Y and the first sustain rising signal is supplied to the sustain electrode Z, a voltage of the sustain electrode Z rises from the first bias voltage Vz1 to the second bias voltage Vb2. As a magnitude of a voltage variation decreases, the peaking noise and the electromagnetic interference caused by the coupling effect between the sustain electrodes or between the scan electrode and the sustain electrode, decrease.

A slope of the first sustain rising signal may substantially range from 2V/μs to 20V/μs. When the slope of the first sustain rising signal substantially ranges from 2V/μs to 20V/μs, an excessive increase in a driving time is prevented, and the noise and the electromagnetic interference decrease.

In the address period of FIG. 3, the scan driver 102 supplies a scan signal falling from the eighth voltage V8 of the the scan bias signal to a negative scan voltage −Vy to the scan electrode Y. When the scan driver 102 supplies the scan signal falling to the negative scan voltage −Vy, the data driver 101 supplies a data signal rising to a data voltage Vd to the address electrode X.

When a voltage difference of the negative scan voltage −Vy and the data voltage Vd adds to a wall voltage due to wall charges formed in the reset period, an address discharge is generated in the discharge cell where the data voltage Vd of the data signal is supplied. The scan driver 102 supplies a rising signal that gradually rises from the scan bias voltage V8 to a ground level voltage after the supply of the scan signal to the last scan electrode, and supplies the ground level voltage to the scan electrode Y before the sustain period. The scan bias voltage V8 may be a negative voltage.

In the address period, the sustain driver 103 supplies a sustain rising signal that gradually rises from the second bias voltage Vz2 of the second bias signal to a third bias voltage Vz3. The sustain driver supplies a third bias signal with a voltage maintained at a third bias voltage Vz3 after the supply of the second sustain rising signal. A slope of the second sustain rising signal may be more than the slope of the first sustain rising signal. A magnitude of the third bias voltage Vz3 may be substantially equal to the magnitude of a sustain voltage Vs which is the highest voltage of the sustain signal supplied in the sustain period.

The sustain driver 103 supplies a sustain falling signal that gradually falls from the third bias voltage Vz3 of the third bias signal to an eleventh voltage V11 to the sustain electrode Z. The eleventh voltage V11 may be substantially equal to the first bias voltage Vz1 of the first bias signal. The eleventh voltage V11 and the first bias voltage Vz1 may be substantially equal to the ground level voltage. A falling slope of the sustain falling signal may be substantially equal to the falling slope of the sustain signal SUS.

A noise generated when the second sustain rising signal is supplied to the sustain electrode, will be described with reference to FIGS. 5*a* and 5*b*.

Figure 5A:
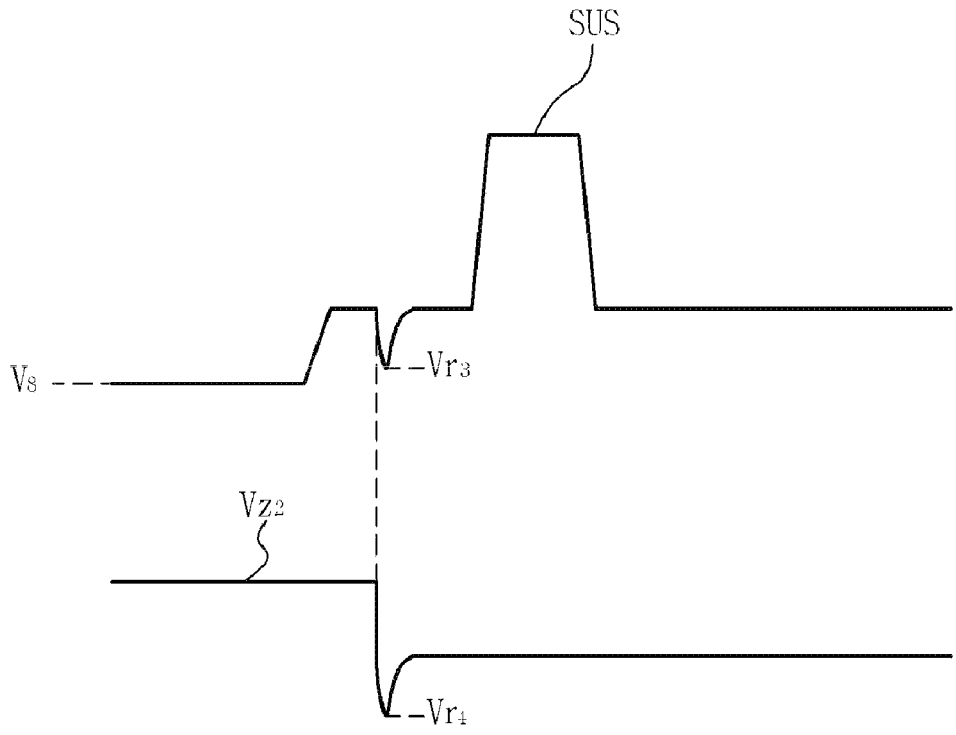
FIG. 5*a* and FIG. 5*b* illustrates a noise generated when a second sustain signal and a sustain falling signal are supplied to the sustain electrode.

As shown in FIG. 5*a*, when the second sustain rising signal and the sustain falling signal are not supplied to the sustain electrode Z, a peaking noise falling to Vr3 or Vr4 is generated due to the coupling effect between sustain electrodes or between the scan electrode and the sustain electrode at a time point when a voltage of the sustain electrode Z falls from the second bias voltage Vz2 to the eleventh voltage V11.

Figure 5B:
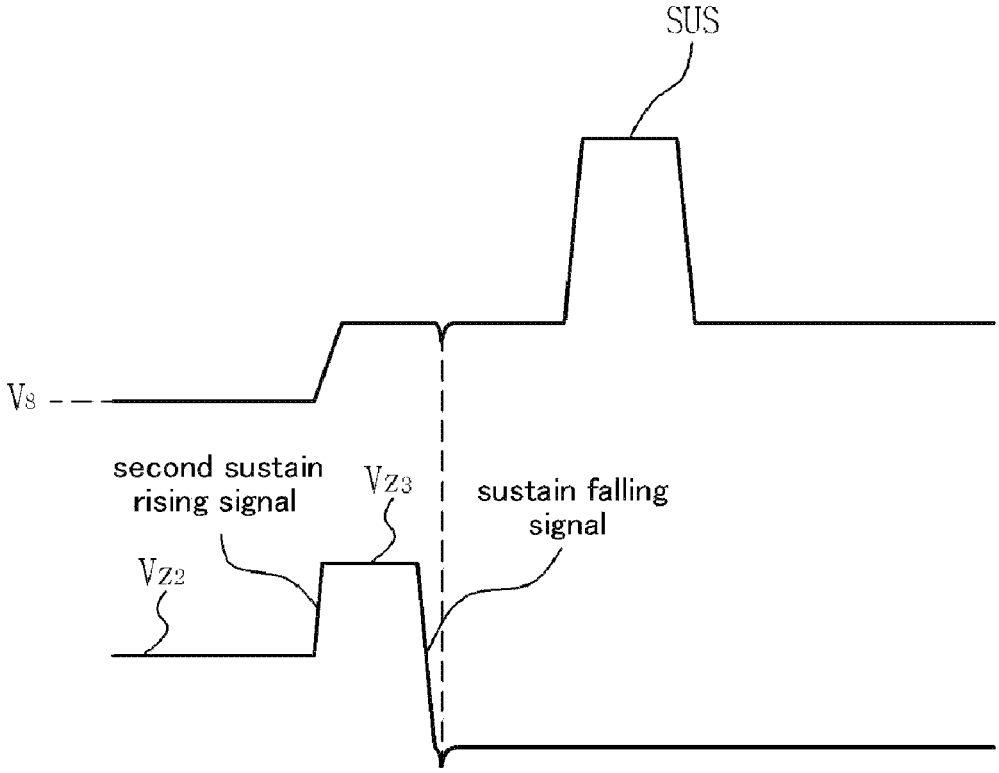

As shown in FIG. 5*b*, when the second sustain rising signal is supplied to the sustain electrode Z, a variation magnitude of a voltage of the sustain electrode Z decreases by rising a voltage of the sustain electrode Z from the second bias voltage Vz2 to the third bias voltage Vz3. Accordingly, the peaking noise and the electromagnetic interference decrease. When the sustain falling signal is supplied to the sustain electrode Z, a variation magnitude of the voltage of the sustain electrode Z decreases by falling a voltage of the sustain electrode Z from the third bias voltage Vz3 to the eleventh voltage V11. Accordingly, the peaking noise and the electromagnetic interference decrease.

In the sustain period, the scan driver 102 and the sustain driver 103 supply a sustain signal SUS to the scan electrode Y or the sustain electrode Z. A sustain discharge is generated in the discharge cell selected in the address period.

Figure 6:
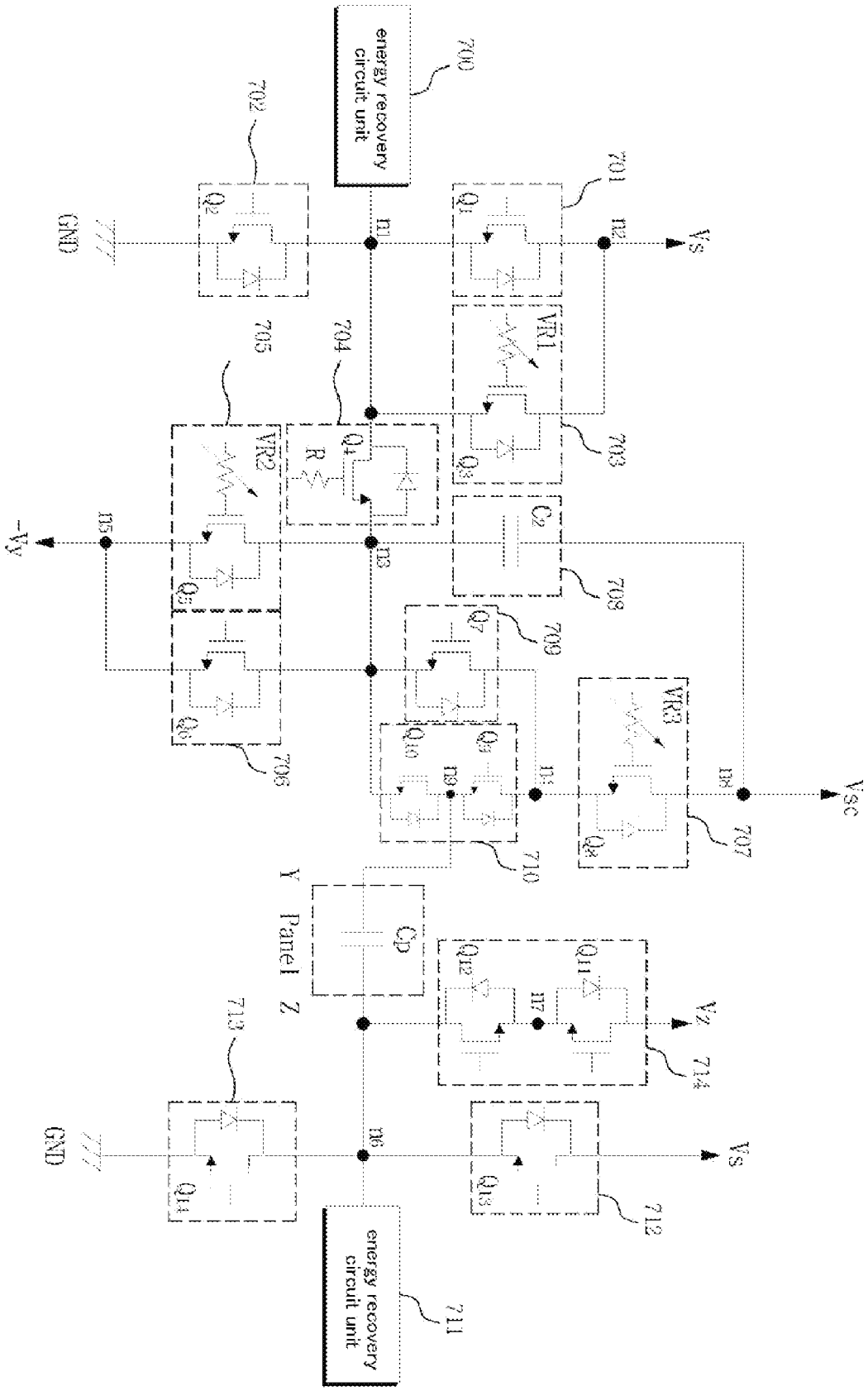
FIG. 6 illustrates a scan driver and a sustain driver of the plasma display apparatus in accordance with the embodiment of the present invention.

FIG. 6 illustrates a scan driver and a sustain driver of the plasma display apparatus in accordance with the embodiment of the present invention. As shown in FIG. 6, the scan driver of the plasma display apparatus in accordance with an embodiment of the present invention a first energy recovery circuit unit 700, a scan drive integrated circuit unit 710, a first sustain voltage supply unit 701, a first base voltage supply unit 702, a first setup signal supply unit 703, a reverse current preventing unit 704, a set-down signal supply unit 705, a scan signal supply unit 706, a second setup/scan bias signal supply unit 707, a buffering unit 708, and a current path selection unit 709.

The sustain driver of the plasma display apparatus in accordance with the embodiment of the present invention comprises a second energy recovery circuit unit 711, a second sustain voltage supply unit 712, a second base voltage supply unit 713, and a bias voltage supply unit 714.

The first energy recovery circuit unit 700 and the second energy recovery circuit unit 711 supply an stored energy to the scan electrode Y or the sustain electrode Z through an energy supply path, and recovers the energy from the scan electrode Y or the sustain electrode Z through an energy recovery path. A structure of the first energy recovery circuit unit 700 may be the same as the structure of the second energy recovery circuit 711.

Figure 7:
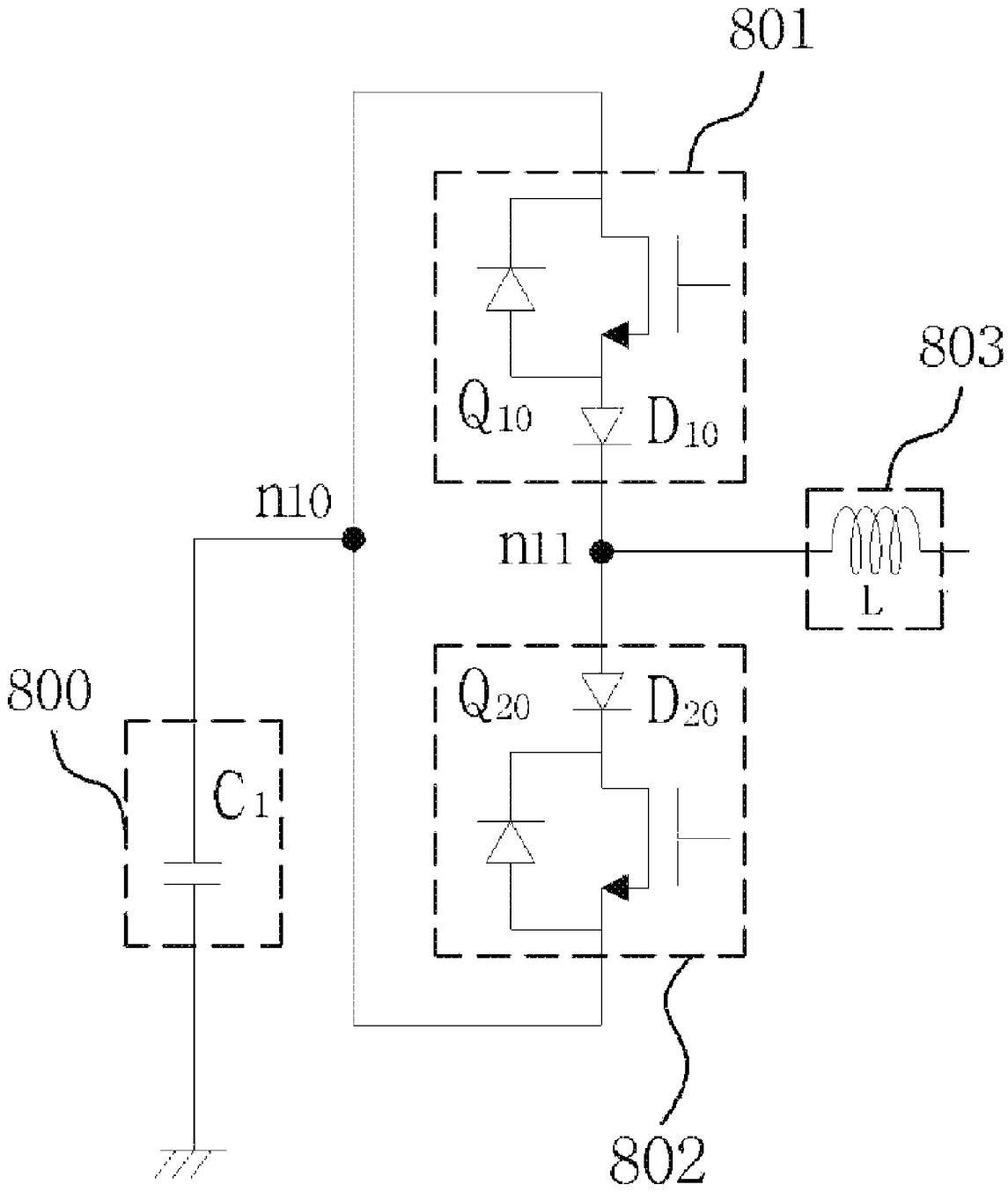
FIG. 7 illustrates an energy recovery circuit unit of the plasma display apparatus in accordance with the embodiment of the present invention.

FIG. 7 illustrates an energy recovery circuit unit of the plasma display apparatus in accordance with the embodiment of the present invention. As shown in FIG. 7, each of the first energy recovery circuit unit 700 and the second energy recovery circuit unit 711 comprises an energy storage unit 800, an energy supply path forming unit 801, an energy recovery path forming unit 802, and a resonance unit 803.

The energy storage unit 800 comprises an energy storage capacitor C1, and the energy storage capacitor C1 stores the energy supplied to the scan electrode Y or the sustain electrode Z, or sores the energy recovered from the scan electrode Y or the sustain electrode Z.

The energy supply path forming unit 801 comprises an energy supply path forming switch unit Q10 and a first reverse current preventing diode unit D10. The energy supply path forming unit 801 causes the energy storage at the energy storage unit 800 to be supplied to the scan electrode Y or the sustain electrode Z through the energy supply path forming switch unit Q10.

The first reverse current preventing diode unit D10 cuts off a reverse current flowing to the energy storage unit 800 through the energy supply path forming switch unit Q10.

The energy recovery path forming unit 802 comprises an energy recovery path forming switch unit Q20 and a second reverse current preventing diode unit D20. The energy recovery path forming unit 802 causes the energy to be recovered from the scan electrode Y or the sustain electrode Z through the energy recovery path forming switch unit Q20.

The second reverse current preventing diode unit D20 cuts off a reverse current flowing from the energy storage unit 800 through the energy supply path forming switch unit Q10.

The resonance unit 803 comprises a resonance inductor L for causing the energy to be supplied to the scan electrode Y or the sustain electrode Z with a resonance or to be recovered from the scan electrode Y or the sustain electrode Z by resonance.

The scan drive integrated circuit unit 710 comprises a scan top switch unit Q9 and a scan bottom switch unit Q10. The scan top switch unit Q9 and the scan bottom switch unit Q10 supply driving signals to the scan electrode Y through a switch operation.

The first sustain voltage supply unit 701 comprises a sustain voltage supply switch unit Q1, and the sustain voltage supply switch unit Q1 supplies a sustain voltage Vs to the scan electrode Y through a switch operation.

The first base voltage supply unit 702 comprises a base voltage supply switch unit Q2, and the base voltage supply switch unit Q2 supplies a base voltage to the scan electrode Y through a switch operation.

The first setup signal supply unit 703 comprises a first variable resistor VR1 and a setup signal supply switch unit Q3. The first variable resistor VR1 is connected to a gate terminal of the setup signal supply switch unit Q3. The first setup signal supply unit 703 supplies the first setup signal to the scan electrode Y. The the first setup signal is formed by the first variable resistor VR1 for a set of a slope of the first setup signal and the first setup signal supply switch unit Q3 operated in an active region.

The reverse current preventing unit 704 comprises a reverse current preventing switch unit Q4, and the reverse current preventing switch unit Q4 prevents a reverse current flowing from a ground to the setdown signal supply unit 705 or the scan signal supply unit 706 through the first base voltage supply unit 702.

The setdown signal supply unit 705 comprises a setdown signal supply switch unit Q5 and a second variable resistor VR2. The setdown signal supply unit 705 supplies the setdown signal to the scan electrode Y. The setdown signal is formed by the setdown signal supply unit Q5 operated in an active region and the second variable resistor VR2 for a set of a slope of the setdown signal.

The scan signal supply unit 706 comprises a scan signal supply switch unit Q6, and supplies the scan signal falling to the scan voltage −Vy to the scan electrode Y through a switch operation of the scan signal supply switch unit Q6.

The second setup/scan bias signal supply unit 707 a common switch unit Q8, and a third variable resistor VR3. The second setup/scan bias signal supply unit 707 supplies a second setup signal or a scan reference voltage Vsc through an operation of the common switch unit Q8 and the third variable resistor VR3.

The buffering unit 708 comprises a buffering capacitor C2, and forms the second setup signal rising from the fourth voltage V4 in FIG. 3 through the buffering capacitor C2.

The current path selection unit 709 comprises a current path selection switch unit Q7, and selects a path of current flowing to the scan drive integrated circuit unit 710 through an operation of the current path selection switch unit Q7.

The sustain driver of the plasma display apparatus in accordance with the embodiment of the present invention comprises an energy recovery circuit unit 711, a second sustain voltage supply unit 712, a second base voltage supply unit 713, and a bias voltage supply unit 714.

The second sustain voltage supply unit 712 comprises a sustain voltage supply switch unit Q13, and supplies a sustain voltage Vs to the sustain electrode Z through an operation of the sustain voltage supply switch unit Q13.

The base voltage supply unit 713 comprises a base voltage supply switch unit Q14, and supplies a base voltage to the sustain electrode Z through an operation of the base voltage supply switch unit Q14

The bias voltage supply unit 714 comprises a first bias voltage supply unit Q11 and a second bias voltage supply switch unit Q12. An anode terminal of a body diode of the first bias voltage supply switch unit Q11 is connected to an anode terminal of the body diode of the second bias voltage supply switch unit Q12. The bias voltage supply unit 714 supplies the second bias voltage Vz2 to the sustain electrode Z through a switching operation of the first bias voltage supply switch unit Q11 and second bias voltage supply switch unit Q12.

Figure 8:
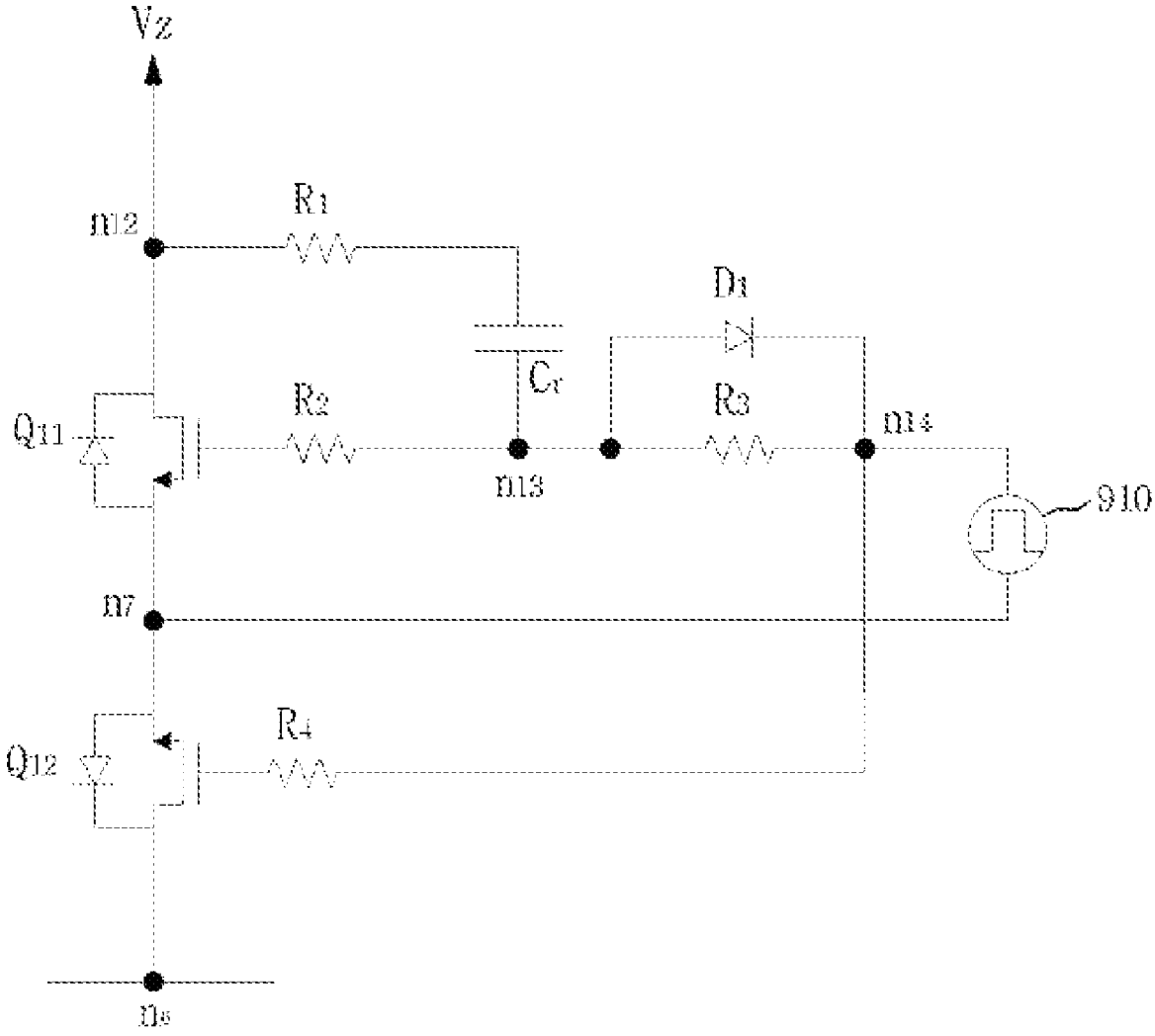
FIG. 8 illustrates a bias voltage supply unit of the plasma display apparatus in accordance with the embodiment of the present invention.

In FIG. 6 or FIG. 8, the scan driver and the sustain driver of the plasma display apparatus in accordance with the embodiment of the present invention comprises a Field Effect Transistor. However, instead of the Field Effect Transistor, the scan driver and the sustain driver may comprise an Insulated Gate Bipolar Transistor. When the scan driver and the sustain driver comprise an Insulated Gate Bipolar Transistor, a current capacity of the scan driver and the sustain driver increases and an operation of a plasma display apparatus becomes more stable.

With reference to FIG. 3, FIG. 6 and FIG. 7, the operation of the scan driver and the sustain driver will be described in detail When the setdown signal supply switch unit Q5 turns on in the pre-reset period, the negative scan voltage −Vy generated by a negative scan voltage source is supplied to the setdown signal supply switch unit Q5 through a fifth node n5.

A slope of the pre-falling signal is controlled by the second variable resistor VR2, and the pre-falling signal is supplied to the scan electrode Y through a third node n3 and the scan bottom switch unit Q10.

The sustain voltage supply switch unit Q13 turns on. Accordingly, the sustain voltage Vs generated by a sustain voltage source is supplied to the sustain electrode Z through the sustain voltage supply switch unit Q13 and a sixth node n6. The second voltage V2 is set to be substantially equal to the sustain voltage Vs.

The base voltage supply switch unit Q2 turns on after the supply of the pre-falling signal. A voltage of the scan electrode Y is the third voltage V3, and the third voltage V3 is set to be substantially equal to a ground level voltage GND.

The base voltage supply switch unit Q14 of the sustain driver turns on. The bias voltage Vz1 substantially equal to the ground level voltage is supplied to the sustain electrode Z.

In the setup period of the reset period, the first setup signal supply switch unit Q3 and the reverse current protecting switch unit Q4 of the scan driver turn on. The sustain voltage Vs is supplied to the first setup signal supply switch unit Q3 through the second node n2. The first setup signal of which a slope is controlled by the first variable resistor VR1 is supplied to the scan electrode Y through the reverse current preventing unit 704, the third node n3, and the scan drive integrated circuit unit 710. Accordingly, the fourth voltage which is the highest voltage of the first setup signal is substantially equal to the sustain voltage Vs.

A turn-on state of the first setup supply switch unit Q3 remains, and the common switch unit Q8 turns on. Accordingly, the scan reference voltage Vsc is supplied to the common switch Q8 through the eighth node n8.

A channel width of the common switch unit Q8 is controlled by the third variable resistor VR3. The second setup signal that gradually rises from the fourth voltage V4 to the fifth voltage V5, is supplied to the scan electrode Y. The fifth voltage V5 is substantially equal to a sum of the sustain voltage Vs and the scan reference voltage Vsc.

After the supply of the second setup signal, the common switch unit Q8 of the scan driver turns off. Accordingly, the sixth voltage that is equal to the sustain voltage Vs is supplied to the scan electrode Y by the first setup signal supply unit 703.

The base voltage supply switch unit Q2, and the third voltage V3 which is equal to the ground level voltage is supplied to the scan electrode Y.

The setdown signal switch unit Q5 turns on in the setdown period, and the negative scan voltage −Vy generated by a negative scan voltage source is supplied to the setdown signal supply switch unit Q5 through the fifth node n5. The setdown signal with a slope controlled by the second variable resistor VR2, is supplied to the scan electrode Y through the third node n3 and the scan bottom switch unit Q10. A voltage of the scan electrode Y falls from the ground level voltage to the seventh voltage V7. The seventh voltage V7 may be set by a switch timing of the setdown signal supply switch unit Q5.

The slope of the pre-falling signal may be substantially equal to the slope of the setdown signal.

A turn-on state of the base voltage supply switch unit Q14 remains during the setup period and the setdown period.

The second setup/scan reference voltage supply switch unit Q8 turns on in the address period. The scan signal supply switch unit Q6 and the current path selection switch unit Q7 turn on. The scan reference voltage Vsc which the scan reference voltage source and the negative scan voltage −Vy which the negative scan voltage source generates, are supplied to the scan top switch unit Q9 through the fourth node.

A channel width of the common switch unit Q8 is controlled by the third variable resistor VR3 and the scan rising signal that gradually rises from the seventh voltage V7 to the eighth voltage V8 is supplied to the scan electrode Y. The eighth voltage V8 that is the scan bias voltage is substantially equal to the sum of the scan reference voltage Vsc and the negative scan voltage −Vy.

The slope of the scan rising signal may be set to be substantially equal to the slope of the second setup signal.

As shown in FIG. 3, after the predetermined duration of d1 period from a start time point of the supply of the scan rising signal, the first sustain rising signal that rises from the first bias voltage Vz1 to the second bias voltage Vz2, is supplied. The d1 period may be less than or equal to 10 μs. When the d1 period is less than or equal to 10 μs, a time margin can be secured. The first sustain rising signal is supplied by the bias voltage supply unit 714 in FIG. 6 and FIG. 8.

FIG. 8 illustrates a bias voltage supply unit of the plasma display apparatus in accordance with the embodiment of the present invention. As shown in FIG. 8, the bias voltage supply unit 714 comprises a first resistor R1, a second resistor R2, a third resistor R3, a fourth resistor R4 and a current path diode D1.

One terminal of the fourth resistor R4 is connected to a gate terminal of the second bias voltage supply switch unit Q12. One terminal of the second resistor R2 is connected to a gate terminal of the bias voltage supply switch unit Q11. One terminal of the first resistor R1 is connected to a node between a drain terminal of the bias voltage supply switch unit Q11 and a bias voltage source.

The other terminal of the first resistor R1 is connected to one terminal of a ramp generation capacitor Cr. The other terminal of the ramp generation capacitor Cr is connected to a thirteenth n13.

The current path diode D1 is connected to the third resistor R3 in parallel, and the other terminal of the current path diode D1, the other terminal of the third resistor R3, and the other terminal of the fourth resistor R4 are connected to one terminal of a control signal supply unit 910. The other terminal of the control signal supply unit 910 is connected to the seventh node n7.

The control signal supply unit 910 supplies a control signal to the fourteenth node n14. The control signal is supplied to the gate terminal of the first bias voltage supply switch unit Q11 through the second resistor R2 and the third resistor R3, and is supplied to the gate terminal of the second bias voltage supply switch unit Q12 through the fourth resistor R4. The first bias voltage supply switch unit Q11 and the second bias voltage supply switch unit Q12 turn on.

When the first bias voltage supply switch unit Q11 and the second bias voltage supply switch unit Q12 turn on, the first rising signal with a slope is supplied to the sustain electrode Z due to the charge of the ramp generation capacitor Cr.

After the supply of the sustain rising signal, the first bias voltage supply unit Q11 and the bias voltage supply switch unit Q12 turn on together. The bias voltage Vz generated by the bias voltage source is supplied to the sustain electrode Z through the first bias voltage supply unit Q11 and the bias voltage supply switch unit. The second bias voltage Vz2 in FIG. 3 is substantially equal to the bias voltage Vz.

The common switch unit Q8 turns off during the supply of the scan bias voltage V8, and a turn-on state of the scan signal supply switch unit Q6 remains. Accordingly, the scan signal that falls to the negative scan voltage −Vy is supplied to the scan electrode Y.

The common switch unit Q8 turns off, and the base voltage supply switch unit Q2 and the reverse current preventing switch unit Q4 turn on. The rising signal is supplied to the scan electrode Y due to a resistor R connected to a gate terminal of the reverse current preventing switch unit Q4. After the supply of the rising signal, the voltage of the scan electrode is maintained at the ground level voltage.

The energy supply path forming switch unit Q10 and the reverse current preventing switch unit Q4 turn on in the address period. The energy stored at the energy storage unit 800 is supplied to the scan electrode Y by LC resonance, and the voltage of the scan electrode Y rises to the sustain voltage Vs. When the sustain voltage supply switch unit Q1 turns on, the voltage of the scan electrode Y is maintained at the sustain voltage Vs.

The sustain voltage supply switch unit Q1 and the energy supply path forming switch unit Q10 turn off, and the energy recovery path forming switch unit 802 turns on. The energy is recovered to the energy storage unit 800 with LC resonance, and the voltage of the scan electrode Y falls from the sustain voltage Vs to the ground level voltage. The base voltage supply switch unit Q2 turns on. The voltage of the scan electrode Y is maintained at the ground level voltage.

After the supply of the second bias signal in FIG. 3, the first bias voltage switch unit Q11 and the second bias voltage supply switch Q12 turn on. The second bias voltage is supplied to the sustain electrode Z, and the first bias voltage switch unit Q11 and the second bias voltage supply switch Q12 turn off. The sustain electrode Z enters a floating state.

When the sustain electrode Z enters the floating state, the second sustain signal is supplied to the sustain electrode Z due to the rising signal that rises from the eighth voltage V8 to the ground level voltage. When the sustain voltage supply switch unit Q13 turns on, the sustain voltage Vs supplied to the sustain electrode through the sixth node n6. The third bias voltage in FIG. 3 may be substantially equal to the sustain voltage Vs. The duration of the supply period of the rising signal may range from 2 μs to 5 μs. When the duration of the supply period of the rising signal ranges from 2 μs to 5 μs, the second rising signal and the sustain falling signal for the decrease of the noise can be formed, and the time margin can be secured. When the duration of the supply period of the scan rising signal ranges 10 μs to 50 μs, the duration of the supply period of the scan rising signal may be 2 times to 25 times more than the duration of the supply period of the scan signal.

The sustain voltage supply switch unit Q13 turns off, and the energy recovery path forming switch unit 802 in FIG. 7 turns on. The energy is recovered to the energy storage unit 800 by LC resonance, and the voltage of the sustain electrode Z falls to the ground level voltage.

Since the operation of the sustain driver in the sustain period is the same as the operation of the scan driver, a description thereof is omitted.

Figure 9:
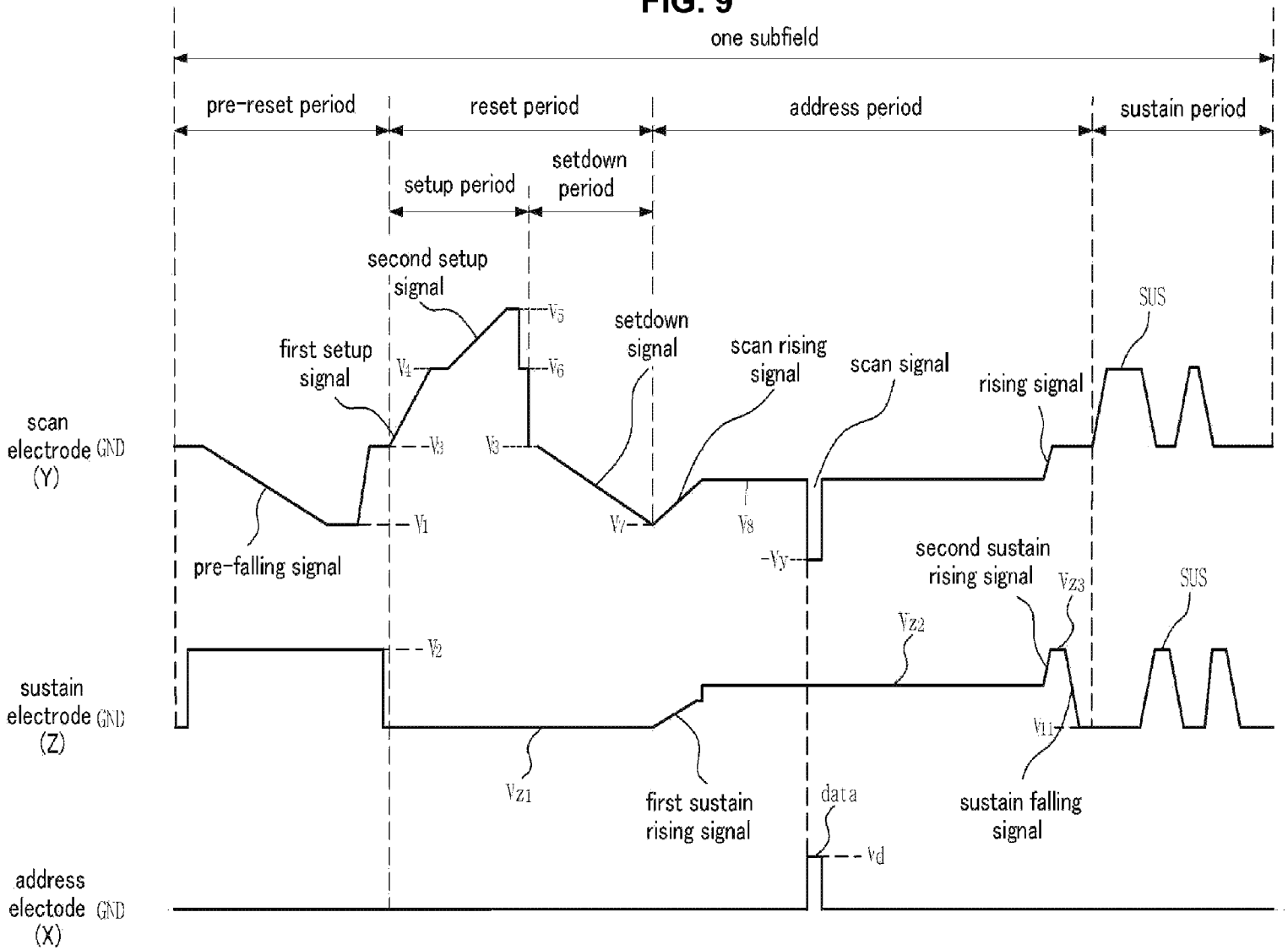
FIG. 9 illustrates another example of the plasma display apparatus in accordance with the embodiment of the present invention.

FIG. 9 illustrates another example of the plasma display apparatus in accordance with the embodiment of the present invention. The first sustina rising signal in FIG. 3 is supplied by the bias voltage supply unit in FIG. 7, however, the sustain rising signal in FIG. 9 is formed due to the floating state of the sustain electrode.

As shown in FIG. 9, the base voltage supply switch unit Q14 in FIG. 6 turns off after the duration of d1 period from the start time point of the scan rising signal. The sustain electrode Z enters a floating state. When the sustain electrode Z enters floating state, the sustain rising signal formed by the scan rising signal is supplied to the sustain electrode Z.

The first bias voltage supply unit Q11 and the second bias voltage supply unit Q12 turn on after the supply of the first sustain rising signal. The bias voltage Vz generated by the bias voltage source is supplied to the sustain electrode Z through the first bias voltage supply switch unit Q11 and the second bias voltage supply switch unit Q12.

Since a waveform of the remaining driving signal except the first sustain rising signal is the same as the waveform of the driving signal in FIG. 3, the description of the waveform of the remaining driving signal is omitted.

The embodiment of the invention being thus described, it will be obvious that the same maybe varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel in which a first electrode and a second electrode are formed;

a first driver for supplying, during an address period of a subfield, a scan rising signal that gradually rises from a third voltage to a fourth voltage to the first electrode; and a second driver for supplying, during the address period of the subfield, a first bias signal with a voltage maintained at a first bias voltage, a first sustain rising signal that gradually rises from the first bias voltage to a second bias voltage and that begins rising while the scan rising signal is gradually rising, and a second bias signal with a voltage maintained at the second bias voltage, to the second electrode.

2. The plasma display apparatus of claim 1, wherein a gradient of the first sustain rising signal ranges from 2 V/μs to 20 V/μs.

3. The plasma display apparatus of claim 1, wherein the second driver comprises a first bias voltage supplying switch unit and a second bias voltage supplying switch unit, wherein the first bias voltage supply switch unit comprises one terminal connected to a bias voltage source, and wherein the second bias voltage supply switch unit comprises one terminal connected to the other terminal of the first bias voltage supply switch unit, and the other terminal connected to the second electrode.

4. The plasma display apparatus of claim 1, wherein the first bias voltage is substantially equal to a ground level voltage.

5. The plasma display apparatus of claim 1, wherein a magnitude of a slope of the rising of the scan rising signal is more than a magnitude of a slope of the rising of the first sustain rising signal.

6. The plasma display apparatus of claim 1, wherein the first driver supplies a rising signal that gradually rises from a scan bias voltage after the supply of the scan rising signal, and the duration of a supply period of the scan rising signal is 2 times to 25 times more than the duration of the supply period of the rising signal.

7. The plasma display apparatus of claim 6, wherein the scan bias voltage is a negative polarity voltage.

8. The plasma display apparatus of claim 1, wherein the second driver causes the second electrode to enter a floating state after a predetermined duration of time from a staff time point of the scan rising signal supplied by the first driver.

9. The plasma display apparatus of claim 8, wherein the predetermined time is equal to or less than 10 μs.

10. The plasma display apparatus of claim 1, the second driver comprises a switch unit for supplying the first sustain rising signal, that gradually rises due to the charge of a ramp generation capacitor, to the second electrode during the supply of the scan rising signal.

11. The plasma display apparatus of claim 1, wherein the second driver supplies a second rising signal that gradually rises from the second bias voltage to a fifth bias voltage, to the second electrode.

12. The plasma display apparatus of claim 11, wherein the fifth bias voltage is substantially equal to a sustain voltage for generating a sustain discharge.

13. The plasma display apparatus of claim 11, wherein the first driver supplies a rising signal that rises from a scan bias voltage to another voltage level to the first electrode, and the second driver causes the second electrode to enter a floating state for forming the second sustain rising signal during the supply of the rising signal.

14. The plasma display apparatus of claim 11, wherein the second driver supplies a third bias signal with a voltage maintained at the fifth voltage, to the second electrode after the supply of the second sustain rising signal.

15. The plasma display apparatus of claim 14, wherein the second driver supplies a sustain falling signal that gradually falls to a ground level voltage after the supply of the fifth bias signal.

16. The plasma display apparatus of claim 1, wherein the first driver supplies one or more setup signals to the first electrode in a reset period.

17. The plasma display apparatus of claim 1, wherein:

supplying the first sustain rising signal comprises supplying the first sustain rising signal a predetermined duration of time from a start time point from when the first driver supplies the scan rising signal.

18. The plasma display apparatus of claim 1, wherein:

supplying the first bias signal, the first sustain rising signal, and the second bias signal comprises supplying the first bias signal at the first bias voltage for a first period of time, supplying the first sustain rising signal by gradually rising from the first bias voltage to the second bias voltage, and supplying the second bias signal at second bias voltage for a second period of time.

19. The plasma display apparatus of claim 1, wherein:

the rising of the first sustain rising signal ends after the scan rising signal has been completely supplied.

20. A driving method of a plasma display apparatus comprising:

supplying, during an address period of a subfield, a scan rising signal that gradually rises from a third voltage to a fourth voltage to the first electrode;

supplying, during the address period of the subfield, a first bias signal with a voltage maintained at a first bias voltage to the second electrode;

supplying, during the address period of the subfield, a first sustain rising signal that gradually rises from the first bias voltage to a second bias voltage to the second electrode and that begins rising while the scan rising signal is gradually rising; and supplying, during the address period of the subfield, a second bias signal with a voltage maintained at the second bias voltage to the second electrode.

21. The driving method of claim 20, wherein the first bias voltage is substantially equal to a ground level voltage.

22. The driving method of claim 20, wherein the second electrode enters a floating state to form the first sustain rising signal during the supply of a scan rising signal to the first electrode.

23. The driving method of claim 22, wherein the second electrode enters the floating state after a predetermined duration of time from a start time point of the scan rising signal.

* * * * *